US012667772B2

(12) United States Patent
Miller et al.

(10) Patent No.: US 12,667,772 B2
(45) Date of Patent: Jun. 30, 2026

(54) VACUUM LOCKING FOR ARTICLE OF ATHLETIC EQUIPMENT

(71) Applicant: NIKE, Inc., Beaverton, OR (US)

(72) Inventors: Todd W. Miller, Portland, OR (US); Matthew D. Nordstrom, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 19/095,920

(22) Filed: Mar. 31, 2025

(65) Prior Publication Data

US 2025/0303263 A1 Oct. 2, 2025

Related U.S. Application Data

(60) Provisional application No. 63/573,070, filed on Apr. 2, 2024.

(51) Int. Cl.
*A63B 71/08* (2006.01)
*A41D 13/018* (2006.01)

(52) U.S. Cl.
CPC ..... *A63B 71/08* (2013.01)

(58) Field of Classification Search
CPC ..... A63B 71/08
See application file for complete search history.

(56) References Cited

U.S. PATENT DOCUMENTS 2,604,297 A * 7/1952 Winstead ..... A47C 27/081 137/859
2,949,927 A * 8/1960 Mackal ..... F16K 15/202 137/859
3,433,455 A * 3/1969 Cook ..... F16K 15/08 251/339
3,446,880 A * 5/1969 Enicks ..... A63B 71/08 2/24
3,849,801 A * 11/1974 Holt ..... A42B 3/121 2/413
5,007,111 A * 4/1991 Adams ..... A41D 13/0155 2/22
5,088,478 A * 2/1992 Grim ..... A43B 7/20 128/DIG. 20
5,113,599 A * 5/1992 Cohen ..... A43B 23/029 36/114

(Continued)

FOREIGN PATENT DOCUMENTS

EP 0640363 A1 3/1995

OTHER PUBLICATIONS

European Patent Office (ISA), International Search Report and Written Opinion for PCT App. No. PCT/US2025/022544, mailed Jun. 30, 2025.

*Primary Examiner* — Robert H Muromoto, Jr.
(74) *Attorney, Agent, or Firm* — Honigman LLP; Matthew H. Szalach; Jonathan P. O'Brien

(57) ABSTRACT

A locking structure for an article includes a bladder including a first barrier element attached to a second barrier element to define a chamber having an interior void. A locking system includes locking elements that each attach to at least one elastic element. The locking elements each include at least one interface surface. The interior void of the bladder operable between a first pressure to move the locking system to a locked state and a second pressure to move the locking system to an unlocked state.

20 Claims, 9 Drawing Sheets

(56) References Cited

U.S. PATENT DOCUMENTS 5,158,767 A * 10/1992 Cohen ..... A43B 23/029 36/114
5,203,793 A * 4/1993 Lyden ..... A43B 7/20 36/43
5,595,004 A * 1/1997 Lyden ..... A43B 13/206 36/35 B
5,765,298 A * 6/1998 Potter ..... A43B 5/00 36/114
5,987,780 A * 11/1999 Lyden ..... A43B 13/203 36/35 B
6,082,025 A * 7/2000 Bonk ..... A43B 13/20 428/424.4
6,127,026 A * 10/2000 Bonk ..... B32B 25/04 428/476.3
6,463,612 B1 * 10/2002 Potter ..... A43B 13/20 36/43
6,591,429 B1 * 7/2003 Jaszai ..... A61F 13/06 251/339
6,837,951 B2 * 1/2005 Rapaport ..... D04B 21/16 156/196
7,219,449 B1 * 5/2007 Hoffberg ..... A43B 1/0054 36/88
9,610,476 B1 * 4/2017 Tran ..... A63F 11/00
2007/0149079 A1 * 6/2007 Vito ..... A63B 71/141 442/181
2008/0092404 A1 * 4/2008 Sokolowski ..... A43B 13/125 36/31
2012/0048663 A1 * 3/2012 McDonnell ..... A43B 13/189 188/266
2015/0354662 A1 * 12/2015 McDonnell ..... A63B 71/1225 188/269
2018/0027893 A1 * 2/2018 Bangera ..... A41D 13/0506
2018/0140025 A1 * 5/2018 Pelletier ..... A41D 13/065
2018/0153244 A1 * 6/2018 Kirshon ..... B29C 39/025
2019/0021717 A1 * 1/2019 Corrigan ..... A61F 5/05833
2020/0116225 A1 * 4/2020 McDonnell ..... A43B 17/035
2022/0202137 A1 * 6/2022 Kiss ..... A43B 13/20
2023/0189907 A1 * 6/2023 Bishop ..... A43B 23/0245 2/1
2024/0324725 A1 * 10/2024 Bishop ..... A43B 23/0285
2024/0365931 A1 * 11/2024 Case ..... A43B 3/26
2024/0415229 A1 * 12/2024 Connell ..... A43B 13/141
2025/0194738 A1 * 6/2025 Farr ..... A43B 5/025

* cited by examiner

VACUUM LOCKING FOR ARTICLE OF ATHLETIC EQUIPMENT

CROSS REFERENCE TO RELATED APPLICATIONS

This application claims priority under 35 U.S.C. § 119(e) to U.S. Provisional Application No. 63/573,070, filed on Apr. 2, 2024. The disclosure of this prior application is considered part of the disclosure of this application and is hereby incorporated by reference in its entirety.

FIELD

The present disclosure relates generally to a locking device for an article of athletic equipment.

BACKGROUND

This section provides background information related to the present disclosure and is not necessarily prior art.

Articles of athletic equipment, such as pads and protective equipment, typically include a receptacle for receiving a body part of a wearer. For example, an article of athletic equipment may include a receiving body and an attachment element that operate to form a receptacle for receiving an appendage of a wearer. Likewise, athletic garments and headwear may include one or more pieces of material formed into a receptacle for receiving a torso or head of a wearer.

Articles of athletic equipment are typically adjustable and/or include a relatively flexible material to allow the article of athletic equipment to accommodate various sizes of wearers, or to provide different fits on a single wearer. While conventional articles of athletic equipment are adjustable, such articles do not typically allow a wearer to lock the size or shape of the article to a body part of the wearer. For example, while adjustable straps adequately secure an article of athletic equipment to a wearer by contracting or constricting the receiving body of the article around the wearer, the adjustable straps do not cause the receiving body to conform to the wearer. Accordingly, an optimum fit of the receiving body around an appendage of a wearer is difficult to achieve.

DRAWINGS

The drawings described herein are for illustrative purposes only of selected configurations and not all possible implementations, and are not intended to limit the scope of the present disclosure.

FIG. 1 is an example of an article of athletic equipment with a locking structure according to the present disclosure, where the locking structure is in a relaxed state;

FIG. 2 a cross-sectional view of a locking structure according to the present disclosure with a bladder and a locking system;

Corresponding reference numerals indicate corresponding parts throughout the drawings.

DETAILED DESCRIPTION

Figure 1:
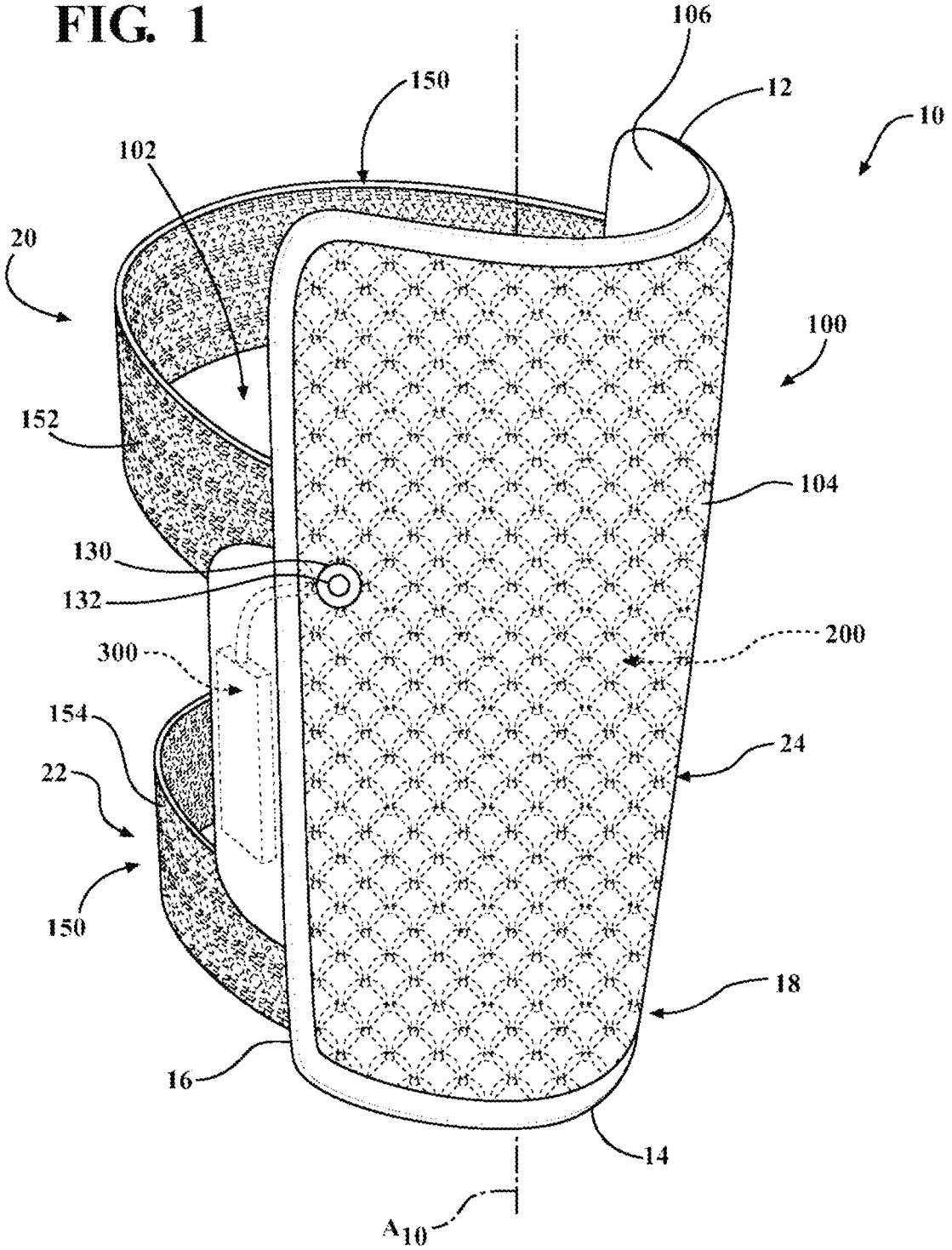

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one configuration, a locking structure for an article includes a bladder having a first barrier element attached to a second barrier element to define a chamber including an interior void, at least one elastic element disposed within the interior void, and a plurality of locking elements disposed within the interior void and each attached to the at least one elastic element, each of the locking elements including an interface surface operable to selectively engage an interface surface of another one of the locking elements.

The locking structure may include one or more of the following optional features. For example, the at least one elastic element may include a first fastening portion coupled to a first attachment region of each of the plurality of locking elements and a second fastening portion coupled to a second attachment region of each of the plurality of locking elements. The first and second attachment regions of each of the plurality of locking elements may be defined along an outer edge of each of the plurality of locking elements and may be asymmetrically coupled to the first and second fastening portions. Additionally or alternatively, the first attachment region may be offset from the second attachment region relative to a longitudinal axis of the at least one elastic element.

In one configuration, each of the plurality of locking elements may define an opening at a central region of each locking element. The first and second attachment regions may be disposed proximate to the opening at the central region of each locking element. Further, the at least one elastic element may include an outer fastening portion coupled to the first attachment region of the plurality of locking elements and an inner fastening portion coupled to the second attachment region of the plurality of locking elements.

At least one elastic element may comprise a locking strip that defines a locking system with the plurality of locking elements, the locking system including a tether attached to one of the first barrier element and the second barrier element. Additionally or alternatively, each of the locking elements may include a pair of interface surfaces disposed on opposite sides of each locking element. The interface surfaces of the locking elements may be in direct contact with the interface surfaces of adjacent locking elements to form a locking layer. An article of athletic equipment may include the locking structure.

In another configuration, a locking structure for an article includes a bladder having a first barrier element attached to a second barrier element to define a chamber having an interior void, and a locking system including locking elements each attached to at least one elastic element and including at least one interface surface, the interior void of the bladder operable between a first pressure to move the locking system to a locked state and a second pressure to move the locking system to an unlocked state.

The locking structure may include one or more of the following optional features. For example, the at least one elastic element may include a first fastening portion coupled to a first attachment region of each of the locking elements and a second fastening portion coupled to a second attachment region of each of the locking elements. The first and second attachment regions of each of the locking elements may be defined along an outer edge of each of the locking elements and may be asymmetrically coupled to the first and second fastening portions. Additionally or alternatively, the first attachment region may be offset from the second attachment region relative to a longitudinal axis of the at least one elastic element.

In one configuration, each of the locking elements may define an opening at a central region of each locking element. The first and second attachment regions may be disposed proximate to the opening at the central region of each locking element. The at least one elastic element may include an outer fastening portion coupled to the first attachment region of the locking elements and an inner fastening portion coupled to the second attachment region of the locking elements.

The at least one elastic element may comprise a locking strip that defines a locking system with the locking elements, the locking system including a tether attached to one of the first barrier element and the second barrier element. Additionally or alternatively, each of the locking elements may include a pair of interface surfaces disposed on opposite sides of each locking element. The interface surfaces of the locking elements may be in direct contact with the interface surfaces of adjacent locking elements to form a locking layer. A shin guard for an article of athletic equipment may include the locking structure.

The details of one or more implementations of the disclosure are set forth in the accompanying drawings and the description below. Other aspects, features, and advantages will be apparent from the description, the drawings, and the claims.

Referring to FIG. 1, an article of athletic equipment 10 includes a body 100 and one or more straps 150 attached to the body 100. As illustrated and described herein, the article of athletic equipment 10 may be a shin guard 10. However, the article of athletic equipment 10 may include any athletic equipment that may be attached to a wearer including, but not limited to, limb and/or appendage braces, pads, etc. The shin guard 10 may include a first end 12 associated with a topmost point of the shin guard 10, and a second end 14 corresponding to a lower-most point of the shin guard 10. A longitudinal axis $A_{10}$ of the shin guard 10 extends along a length of the shin guard 10 from the first end 12 to the second end 14 parallel to a shin of a wearer, and generally divides the shin guard 10 into a first side 16 and a second side 18. Accordingly, the first side 16 and the second side 18 respectively correspond with opposite sides of the shin guard 10 and extend from the first end 12 to the second end 14. As used herein, a longitudinal direction refers to the direction extending from the first end 12 to the second end 14, while a lateral direction refers to a direction transverse to the longitudinal direction and extending from the first side 16 to the second side 18.

The shin guard 10 may be divided into one or more regions. The regions may include an upper attachment region 20, a lower attachment region 22, and a coverage region 24. The upper attachment region 20 is associated with an upper strap 152 and the lower attachment region 22 is associated with a lower strap 154. The coverage region 24 may correspond with portions of a wearer that are protected by the article of athletic equipment 10, such as a shin.

The body 100 and the straps 150 collectively define an interior void 102, which receives and secures an appendage of the wearer. The body 100, and components thereof, may be described as including various subcomponents or regions. For example, the body 100 includes an exterior region 104 and an interior region 106 opposite the exterior region 104 and configured to contact an appendage of the wearer during use.

In the example of FIG. 1, the body 100 includes a locking structure 200, described in more detail below, incorporated into the exterior portion 104. By incorporating the locking structure 200 into the body 100, the shin guard 10 is operable to transition between an unlocked or relaxed state and a locked or constricted state. In use, the shin guard 10 is moved between the unlocked or relaxed state and the locked or constricted state by adjusting a pressure of the locking structure 200. For example, a wearer may place the shin guard 10 over a shin of the wearer while the shin guard 10 is in the relaxed state to accommodate the athlete's leg. Once in position, the wearer may apply any means of negative pressure (e.g., vacuum, external force, etc.,) to transition the locking structure 200 incorporated into the body 100 of the shin guard 10 to the locked and constricted state to conform the shin guard 10 to the athlete's leg, as discussed below with respect to the examples of FIGS. 3A-5C. Additionally or alternatively, the locking structure 200 may be received within one or both of the straps 150. As such, when fluid is removed from the locking structure 200 and the locking structure 200 is moved into the locked or constricted state, the straps 150 constrict around the leg of the wearer, thereby providing a snug and customized fit.

Figure 2:
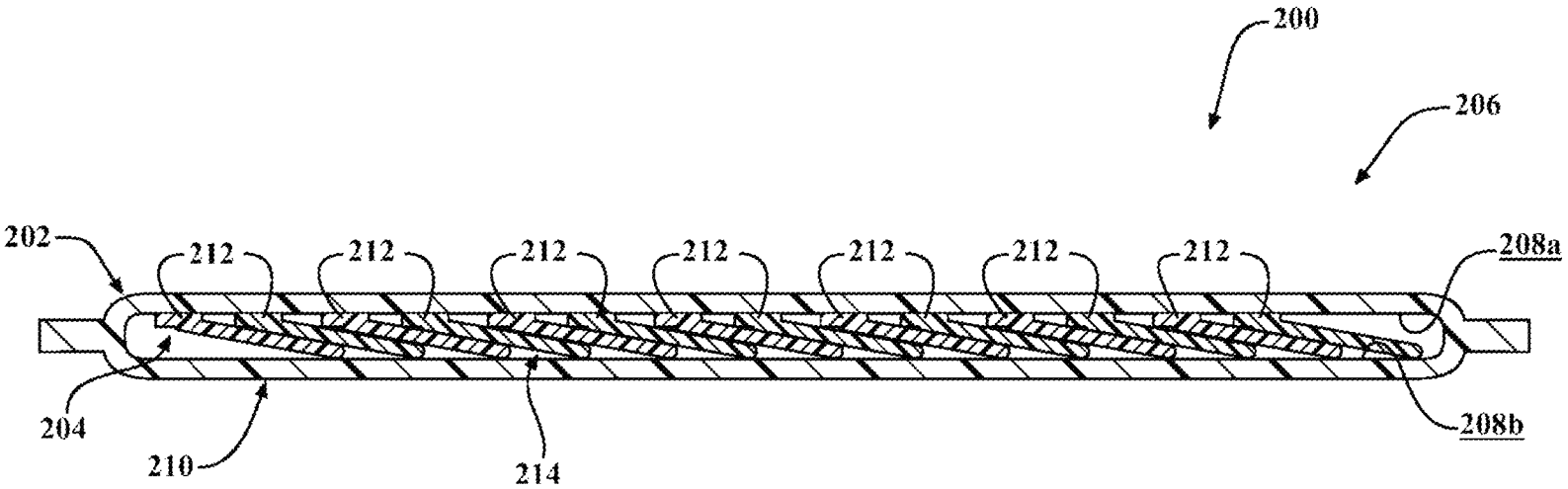

With reference to FIGS. 1 and 2, the shin guard 10 includes a port 130, which is in fluid communication with a pump 300. As described in more detail below, the pump 300 and the port 130 cooperate to define the negative, vacuum pressure within a bladder 202 of the locking structure 200. The bladder 202 defines an interior void 204, and the locking structure 200 is moved between the unlocked or relaxed state and the locked or constricted state by adjusting the fluid pressure within the interior void 204 of the bladder 202. For example, the pressure within the interior void 204 may be reduced by drawing fluid from within the interior void 204 through the port 130, which is attached to the bladder 202. In other words, a vacuum may be applied to the interior void 204 to remove fluid from the interior void 204. The drawing of the vacuum within the interior void 204 selectively transitions an interior pressure of the interior void 204 between a first pressure and a second pressure. It is generally contemplated that the first pressure of the interior void 204 may be greater than the second pressure. For example, the first pressure may be greater than or equal to ambient pressure, and the second pressure of the interior void 204 may be less than ambient pressure. The pump 300 may cause the interior void 204 to move from the first pressure to the second pressure by removing fluid from within the interior void 204. In so doing, the pump 300 causes contraction of the locking structure 200. It is contemplated that the port 130 may be configured with a valve 132, such as a spring valve, for releasing the negative pressure to transition the locking structure 200 from the locked state back to the unlocked state. For example, a wearer may depress the valve 132 when desired to release or otherwise remove the negative pressure within the shin guard 10 by allowing a fluid, such as air, to enter the interior void 204 via the valve 132. In so doing, the locking structure 200 is permitted to return to an expanded state.

Referring still to FIGS. 1 and 2, the locking structure 200 includes a locking system 206, described below, attached to the bladder 202. In this configuration, the bladder 202 includes a first barrier layer 208*a* (e.g., a first barrier element 208*a*) attached to a second barrier layer 208*b* (e.g., a second barrier element 208*b*) formed on an opposite side of the bladder 202 from the first barrier layer 208*a*. A distance between the first barrier layer 208*a* and the second barrier layer 208*b* defines a thickness of the bladder 202 and serves to define a chamber 210 that includes the interior void 204.

As used herein, the term "barrier layer" (e.g., barrier layers 208*a*, 208*b*) encompasses both monolayer and multilayer films. In some embodiments, one or both of the barrier layers 208*a*, 208*b* are each produced (e.g., thermoformed or blow molded) from a monolayer film (a single layer). In other embodiments, one or both of the barrier layers 208*a*, 208*b* are each produced (e.g., thermoformed or blow molded) from a multilayer film (multiple sublayers). In either aspect, each layer or sublayer can have a film thickness ranging from about 0.2 micrometers to about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

One or both of the barrier layers 208*a*, 208*b* can be independently transparent, translucent, and/or opaque. As used herein, the term "transparent" for a barrier layer and/or a chamber means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layers 208*a*, 208*b* can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), (1,5-tetrahydronaphthalene diisocyanate, para-phenylene diisocyanate (PPDI), 3,3'-dimethyldiphenyl-4,4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The barrier layers 208*a*, 208*b* may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entirety. In embodiments where the barrier layers 208*a*, 208*b* include two or more sublayers, examples of suitable multilayer films include microlayer films, such as those disclosed in Bonk et al., U.S. Pat. No. 6,582,786, which is incorporated by reference in its entirety. In further embodiments, the barrier layers 208*a*, 208*b* may each independently include alternating sublayers of one or more TPU copolymer materials and one or more EVOH copolymer materials, where the total number of sublayers in each of the barrier layers 208*a*, 208*b* includes at least four (4) sublayers, at least ten (10) sublayers, at least twenty (20) sublayers, at least forty (40) sublayers, and/or at least sixty (60) sublayers.

The chamber 210 can be produced from the barrier layers 208*a*, 208*b* using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the barrier layers 208*a*, 208*b* can be produced by co-extrusion followed by vacuum thermoforming to produce the chamber 210.

The chamber 210 desirably has a low gas transmission rate to preserve its retained gas pressure. In some embodiments, the chamber 210 has a gas transmission rate for nitrogen gas that is at least about ten (10) times lower than a nitrogen gas transmission rate for a butyl rubber layer of substantially the same dimensions. In an aspect, chamber 210 has a nitrogen gas transmission rate of 15 cubic-centimeter/square-meter·atmosphere·day ($cm^3/m^2 \cdot atm \cdot day$) or less for an average film thickness of 500 micrometers (based on thicknesses of the barrier layers 208*a*, 208*b*). In further aspects, the transmission rate is 10 $cm^3/m^2 \cdot atm \cdot day$ or less, 5 $cm^3/m^2 \cdot atm \cdot day$ or less, or 1 $cm^3/m^2 \cdot atm \cdot day$ or less.

In some implementations, the first barrier layer 208*a* and the second barrier layer 208*b* cooperate to define a geometry (e.g., thicknesses, width, and lengths) of the chamber 210. In some examples, the barrier layers 208*a*, 208*b* may include the same materials to provide the chamber 210 with a homogenous barrier construction, such that both sides of the locking structure 200 will contract and relax at the same rate when pressure within the chamber 210 is adjusted. Alternatively, a first one of the barrier layers 208*a*, 208*b* may be at least partially constructed of a different barrier material and/or configuration than the other one of the barrier layers 208*a*, 208*b* to selectively impart a contour as the locking structure 200 transitions between the relaxed state and the locked state. For example, one of the barrier layers 208*a*, 208*b* may be at least partially formed with a different modulus of elasticity and/or stiffness than the other barrier layer 208*a*, 208*b*, such that when the locking structure 200 transitions from the relaxed state to the locked state, the first one of the barrier layers 208*a*, 208*b* contracts at a different rate than the other barrier layer 208*a*, 208*b* to cause the locking structure 200 to curl.

Referring again to FIGS. 1 and 2, the locking system 206 includes at least one elastic element 212 and a plurality of locking elements 214. The plurality of locking elements 214 are coupled to the elastic element 212. The plurality of locking elements 214 may be disposed within the interior void 204 of the chamber 210, and the elastic element 212 may be attached to at least one of the first barrier layer 208*a* and the second barrier layer 208*b* to form the locking system 206. As depicted in FIG. 2, the locking system 206, including the locking elements 214 and elastic element 212, is coupled to the bladder 202 within the interior void 204. As discussed in greater detail below, the plurality of locking elements 214 are operable to transition the locking system 206 of the locking structure 200 between an unlocked state, where the bladder 202 is free to stretch and conform around a wearer, and a locked state, where the bladder 202 is restricted or locked from stretching.

FIG. 1 is illustrated with a generic representation of a locking structure 200 and locking system 206 in a matrix configuration, but may include any one or more of the locking systems 206*a*-206*d* as provided in FIGS. 3A-5C. The locking system 206 of the locking structure 200 is operable between the locked and unlocked state in response to an at least partial vacuum defined within the interior void 204 of the chamber 210, as described in more detail below. Optionally, the locking system 206 may be provided in a force-responsive configuration that does not utilize a vacuum to move the locking system 206 from the unlocked state to the locked state. For example, the locking system 206 may be configured to lock in response to reactive forces applied to the locking system 206 by the leg. For example, during low-energy movements (e.g., walking) the elastic forces of the elastic element 212 may bias the locking system 206 towards a contracted, unlocked state. However, during high-energy movements (e.g., cutting, stopping, starting), the barrier layers 208*a*, 208*b* and the elastic element 212 may stretch in response to forces applied to the body 100 (FIG. 1). As the barrier layers 208*a*, 208*b* and the elastic element 212 are stretched around the leg, the locking elements 214 are collapsed upon each other to form a locking layer 218, thereby limiting the amount of stretch in the elastic element 212 and, consequently, the barrier layers 208*a*, 208*b*. Thus, unlike applications including a vacuum locking configuration, in which the locking system 206 is continuously locked under the force of a vacuum, force-responsive configurations are tuned to lock in response to threshold forces caused by movements of the leg and/or stretching of the straps 150 around the leg. The threshold forces for locking and unlocking the locking system 206 may be turned by modifying the spacing, quantity, size, shape, and/or surface textures of the locking elements 214.

Figure 3A:
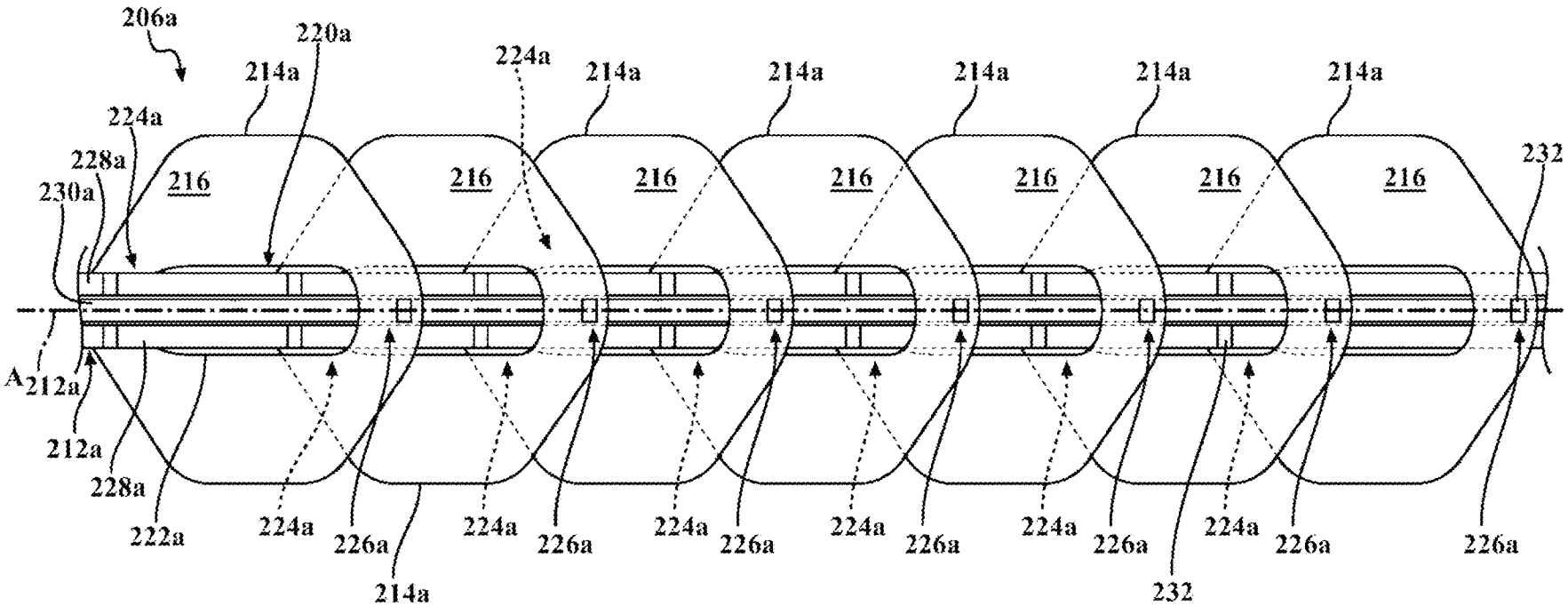
FIG. 3A is an example of a locking structure according to the present disclosure, where the locking structure is in a relaxed state.
Figure 3B:
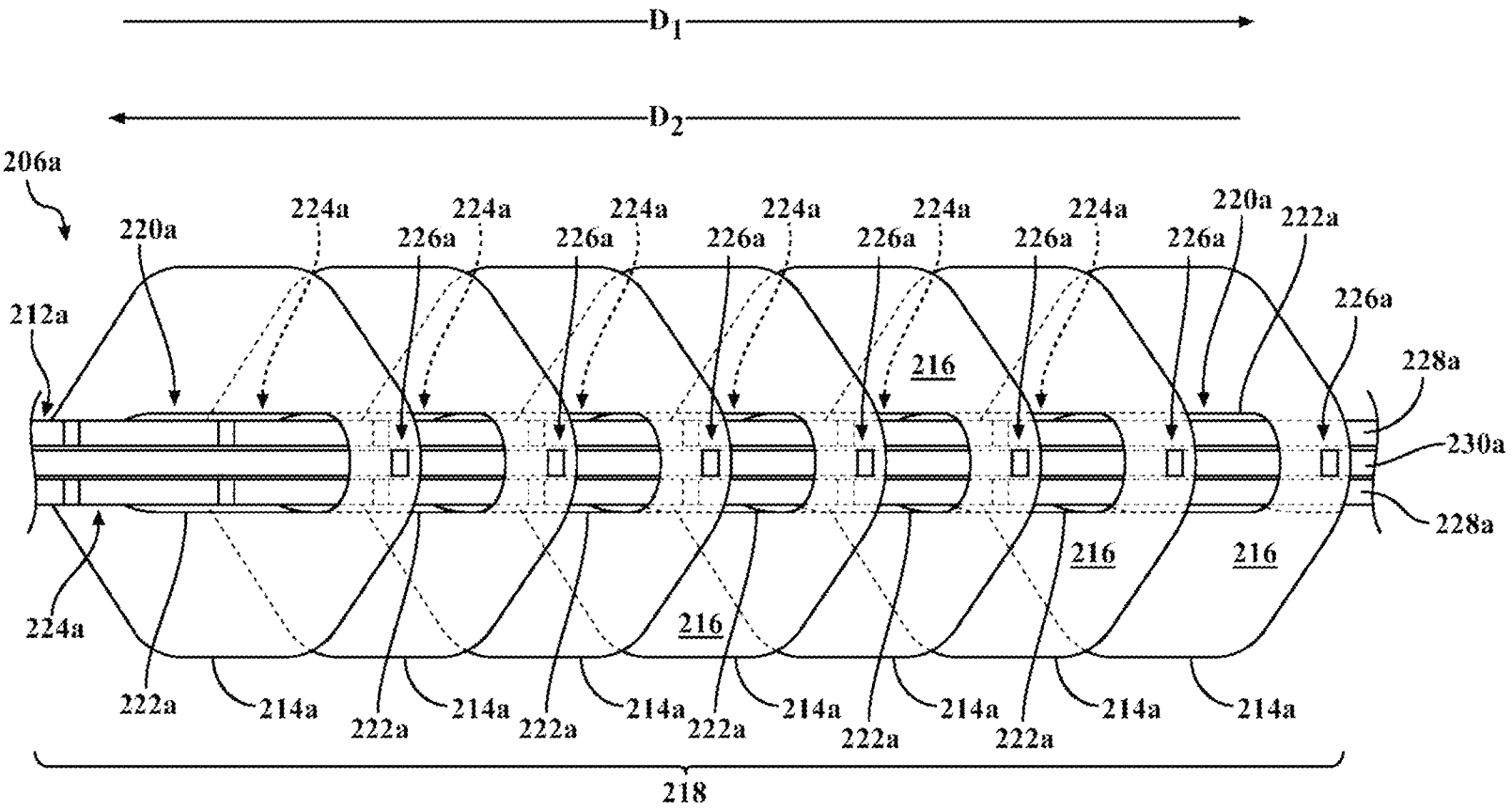
FIG. 3B is a plan view of an example of the locking structure of FIG. 3A, where the locking structure is in a constricted state.
Figure 3C:
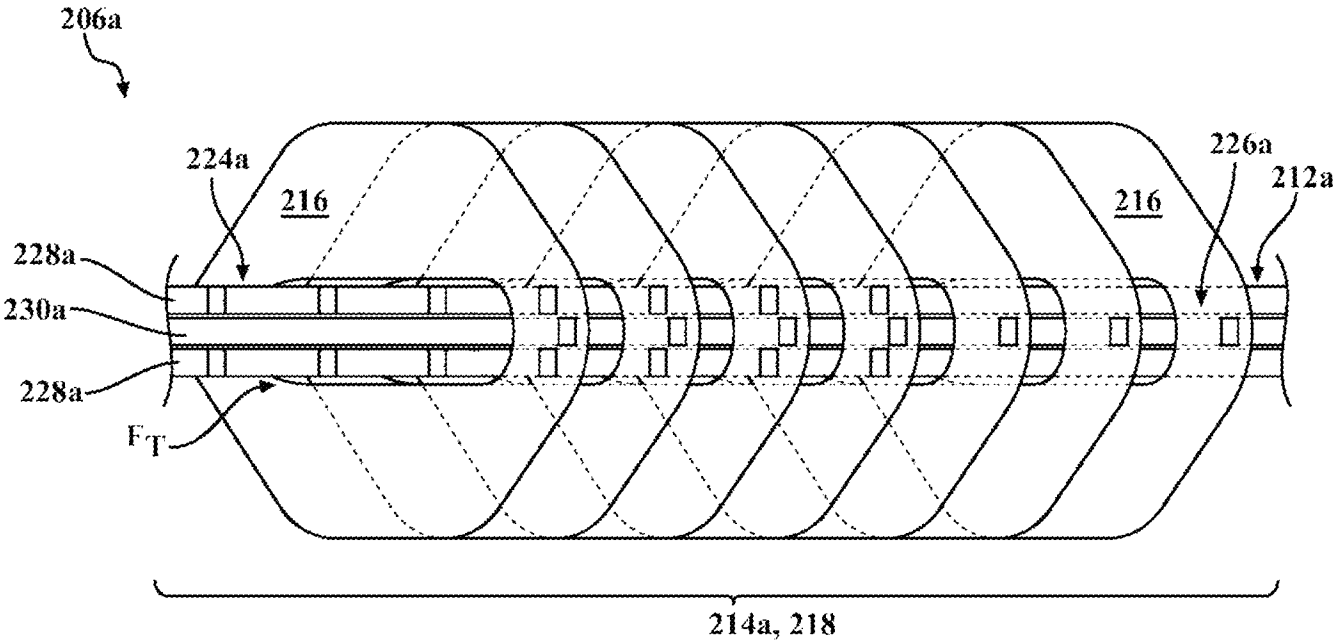
FIG. 3C is an example of the locking structure of FIG. 3B, where the locking structure is in a locked state.

With reference to FIGS. 3A-3C, an example of a locking system 206*a* is illustrated and may be incorporated into the locking structure 200 described above. The locking system 206*a* includes an elastic element 212*a* and a plurality of locking elements 214*a* coupled to the elastic element 212*a*. Each locking element 214*a* in the plurality of locking elements 214*a* includes at least one interface surface 216 configured to cooperate with an opposing interface surface 216 of an adjacent one of the locking elements 214*a* to maintain the locking system 206*a* in the locked state. The interface surface 216 may be formed from a tacky material, such that the material of adjacent interface surfaces 216 may be coupled in the locked state of the locking elements 214*a*. Namely, when the interface surfaces 216 of adjacent locking elements 214*a* are in contact with one another, the frictional engagement therebetween causes the adjacent locking elements 214*a* to be fixed for movement with one another. Because the adjacent locking elements 214*a* are fixed for movement with the elastic element 212*a* which, in turn is fixed for movement with the barrier layers 208*a*, 208*b*, relative movement between the barrier layers 208*a*, 208*b* is restricted and the overall structure helps to lock in a body part of the wearer (i.e., a leg, a shin, etc.).

As discussed in greater detail below, the interface surfaces 216 of the locking elements 214*a* may include textured and/or high-friction materials configured to restrict or prevent relative movement between opposing interface surfaces 216 when pressed into contact with one another (i.e., when a vacuum is drawn and fluid is removed from the chamber 210). Accordingly, when the interface surface 216 of one locking element 214*a* in the plurality of locking elements 214*a* is in contact with an interface surface 216 of a second locking element 214*a* in the plurality of locking elements 214*a*, the locking elements 214*a* cooperate to create a relatively rigid locking layer 218.

In this example, the plurality of locking elements 214*a* are coupled to a single elastic element 212*a*. In some implementations, the plurality of locking elements 214*a* are integrally formed with the elastic element 212*a*. In other implementations, the plurality of locking elements 214*a* are mechanically attached to the elastic element 212*a* (e.g., individually welded and/or attached via a suitable adhesive). As shown in FIG. 3A, the plurality of locking elements 214*a* are coupled to the elastic element 212*a* via a central region 220*a* of each of the plurality of locking elements 214*a*. Each of the plurality of locking elements 214*a* may define an opening 222*a* at the central region 220*a* through which the elastic element 212*a* extends. Each of the locking elements 214*a* has first and second attachment regions 224*a*, 226*a* generally defined at the central region 220*a* where each of the plurality of locking elements 214*a* is coupled to the elastic element 212*a*. For example, the first attachment region 224*a* and the second attachment region 226*a* may be aligned with the opening 222*a* along a longitudinal axis $A_{212a}$ of the elastic element 212*a*. In some examples, the first attachment region 224*a* and the second attachment region 226*a* are formed at opposite ends of the opening 222*a*.

The elastic element 212*a* illustrated in FIG. 3A includes at least one first or outer fastening portion 228*a* and at least one second or inner fastening portion 230*b*. For example, the elastic element 212*a* illustrated in FIG. 3A includes two outer fastening portions 228*a* and a single inner fastening portion 230*a*. It is contemplated that the inner fastening portion 230*a* may selectively translate independent of the outer fastening portions 228*a*, which may assist in drawing the locking elements 214*a* together, as described below. For example, the inner fastening portion 230*a* may contract in a first direction $D_1$, while the outer fastening portions 228*a* may contract in a second direction $D_2$ to flatten the locking elements 214*a* along one another to define the locked state (FIG. 3C). The first attachment region 224*a* of each of the locking elements 214*a* may be coupled to the outer fastening portion 228*a* and the second attachment region 226*a* of the locking elements 214*a* may be coupled to the inner fastening portion 230*a*. For example, the first attachment region 224*a* is depicted as having two attachment points 232 at the outer fastening portions 228*a*, and the second attachment region 226*a* is depicted as having a single attachment point 232 at the inner fastening portion 230*a*.

The elastic element 212*a* contracts as the locking system 206*a* transitions from the unlocked state (FIG. 3A) to the locked state (FIG. 3C), such that there is an increase in the overlap of adjacent ones of the locking elements 214*a*, as described in more detail below. While in the relaxed state (FIG. 3A), the interface surfaces 216 of each the first plurality of locking elements 214*a* are spaced apart and separated from the interface surfaces 216 of the adjacent locking elements 214*a*. When the pressure in the interior void 204 (FIG. 2) is reduced from a first pressure (e.g., at or above ambient) to a second pressure (e.g., at or below ambient), the barrier layers 208*a*, 208*b* (FIG. 2) move toward one another to bring the interface surfaces 216 of the plurality of locking elements 214*a* into direct contact with the opposing interface surfaces 216 of the adjacent locking elements 214*a*. Once the first plurality of locking elements 214*a* are in direct contact with the interface surfaces 216 of the adjacent locking elements 214*a*, the resulting friction between the interface surfaces 216 forms a locking layer 218 that maintains the locking system 206*a* in the locked state of FIG. 3C.

While in the locked state, tensile forces $F_T$ applied along the lengths of the elastic element 212*a* are opposed by the frictional forces between the interface surfaces 216 of the locking elements 214*a*. The bladder 202 (FIG. 2) is thus restricted from stretching or deforming around the wearer when the locking system 206*a* is in the locked state. When the wearer unlocks the locking system 206*a*, to loosen the article, the wearer increases the pressure within the interior void 204 of the bladder 202 (FIG. 2) to move the interface surfaces 216 of the plurality of locking elements 214*a* away from one another to define a space therebetween (FIG. 3A). Consequently, the interface surfaces 216 of the respective locking elements 214*a* disengage from each other to allow the barrier layers 208*a*, 208*b* (FIG. 2) to stretch and deform. For example, FIGS. 3A-3C show the transition between the unlocked state (FIG. 3A) and the locked state (FIG. 3C) with an intermediate or partially locked state (FIG. 3B) in between. The intermediate state may correspond to the transition of the plurality of locking elements 214*a* toward and/or away from one another. In one example, the pressure within the interior void 204 (FIG. 2) is such that the locking elements 214*a* are in the intermediate or partially locked state, such that the interface surfaces 216 partially engage with one another to restrain and otherwise restrict movement of the bladder 202 (FIG. 2).

Referring still to FIGS. 3A-3C, the locking elements 214*a* of the present example include a pair of the interface surfaces 216 disposed on opposite sides of each of the locking elements 214*a*. The interface surfaces 216 engage to retain the locking system 206*a* in the locked state while the locking system 206*a* is under the at least partial vacuum. Stated differently, the locking elements 214*a* frictionally engage at the interface surfaces 216 under the second pressure of the locking system 206*a* to compress the elastic element 212*a* and define the locked state to minimize movement of the bladder 202 (FIG. 2) and create a rigid and supportive fit of the article. While in the relaxed state (FIG. 3A), the locking elements 214*a* of adjacent ones of the plurality of locking elements 214*a* disposed on the elastic element 212*a* are arranged in a spaced apart manner to prevent direct contact between the interface surfaces 216 of the plurality of locking elements 214*a*. In this relaxed state, the locking system 206*a* is relatively flexible and can conform and stretch to fit a variety of geometries.

Figure 4:
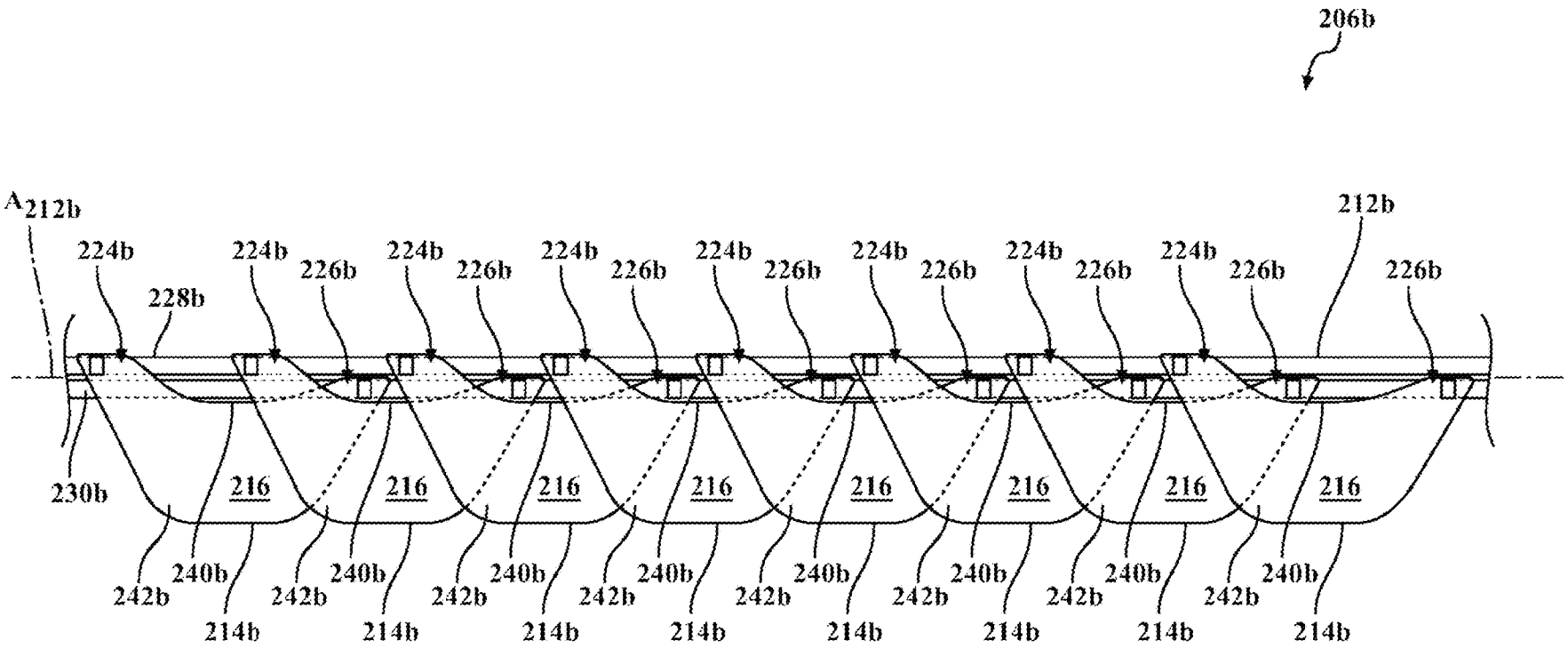
FIG. 4 is an example of a locking structure according to the present disclosure, where the locking structure is in a relaxed state.

With particular reference to FIG. 4, a locking system 206*b* is provided and may be incorporated in the locking structure 200 and/or bladder 202 described above. In view of the substantial similarity in structure and function of the components associated with the locking system 206*a*, like reference numerals are used hereinafter and in the drawings to identify like components while like reference numerals containing letter extensions are used to identify those components that have been modified.

The locking system 206*b* includes a plurality of locking elements 214*b* operably coupled to an elastic element 212*b*. Unlike the locking system 206*a* depicted in FIGS. 3A-3C, the plurality of locking elements 214*b* are coupled to the elastic element 212*b* at an outer edge 240*b* of the plurality of locking elements 214*b*. As depicted, the outer edge 240*b* attached to the elastic element 212*b* has a first attachment region 224*b* and a second attachment region 226*b*, in FIG. 4. The first attachment region 224*b* is coupled to a first fastening portion 228*b* of the elastic element 212*b*, and the second attachment region 226*b* is coupled to a second fastening portion 230*b* of the elastic element 212*b*. As illustrated in FIG. 4, the first and second fastening portions 228*b*, 230*b* of the elastic element 212*b* are adjacent to one another, such that the outer edge 240*b* of the locking elements 214*b* is asymmetrically coupled to the first and second fastening portions 228*b*, 230*b* at the first and second attachment regions 224*b*, 226*b*, respectively. For example, the first attachment region 224*b* coupled to the first fastening portion 228*b* of the elastic element 212*b* is offset from the second attachment region 226*b* of the locking element 214*b* relative to a longitudinal axis A212*b* of the elastic element. In other words, the first attachment region 224*b* is disposed on a first side of the longitudinal axis $A_{212b}$ and the second attachment region 226*b* is disposed on an opposite side of the longitudinal axis $A_{212b}$ from the first attachment region 224*b*. The asymmetrical configuration of the first and second attachment regions 224*b*, 226*b* may assist in providing an adaptive fit, such that one of the locking elements 214*b* may have a greater degree of flexion at one end compared to the other. Additionally or alternatively, the locking elements 214*b* may have an equal degree of flexion across the interface surface 216. It is also contemplated that the asymmetrical configuration defines an overlap between the interface surfaces 216 that maximizes the locking capabilities of the locking elements 214*b* by defining a degree of friction between the interface surfaces 216.

The locking elements 214*b* may be coupled to the elastic element 212*b* at the outer edge 240*b* to provide additional flexibility to the locking system 206*b* in the unlocked state, such that a free end 242*b* of the locking elements 214*b* may have a greater degree of flexion than the retained outer edge 240*b*. The free end 242*b* of each of the locking elements 214*b* may overlap, such that the interface surfaces 216 of each adjacent locking element 214*b* may overlap to define a locking layer 218. The free ends 242*b* may also conform and have an increased degree of flexibility and pliability with respect to the wearer, as the free ends 242*b* are free from attachment with the elastic element 212*b*. While the free ends 242*b* of the locking elements 214*b* may have an increased level of flexibility and/or mobility relative to the outer edge 240*b*, it is contemplated that in the locked state the free ends 242*b* are generally contained and restrained via the frictional engagement between the interface surfaces 216 to form the locking layer 218. The locking system 206*b* operates in a similar manner as described with respect to the locking system 206*a* (FIGS. 3A-3C), such that an interface surface 216 of each of the plurality of locking elements 214*b* may overlap to be in direct contact with an interface surface 216 of an adjacent locking element 214*b* when the second pressure is defined within the interior void 204 (FIG. 2). As described above, the resulting friction between the interface surfaces 216 forms the locking layer 218 that maintains the locking system 206*b* in the locked state.

As discussed above, when the locking system 206*b* is incorporated within a bladder 202 and/or locking structure 200 described above, the pressure of the interior void 204 of the chamber 210 is reduced from the first pressure (e.g., ambient) to the second pressure (e.g., below ambient). In this state, the barrier layers 208*a*, 208*b* move toward one another to bring the plurality of locking elements 214*b* into direct contact with one another at the interface surfaces 216, where each locking element 214*b* in the plurality of locking elements 214*b* overlaps adjacent locking elements 214*b*. Thus, as mentioned above, the interface surface 216 on a first side of one of the locking elements 214*b* will engage the opposing interface surface 216 on the second side of an adjacent one of the locking element 214*b*. Once the plurality of locking elements 214*b* are overlapping and in direct contact with one another at their respective interface surfaces 216, the resulting friction between the interface surfaces 216 forms the locking layer 218 that maintains the locking system 206*b* in the locked state.

Figure 5A:
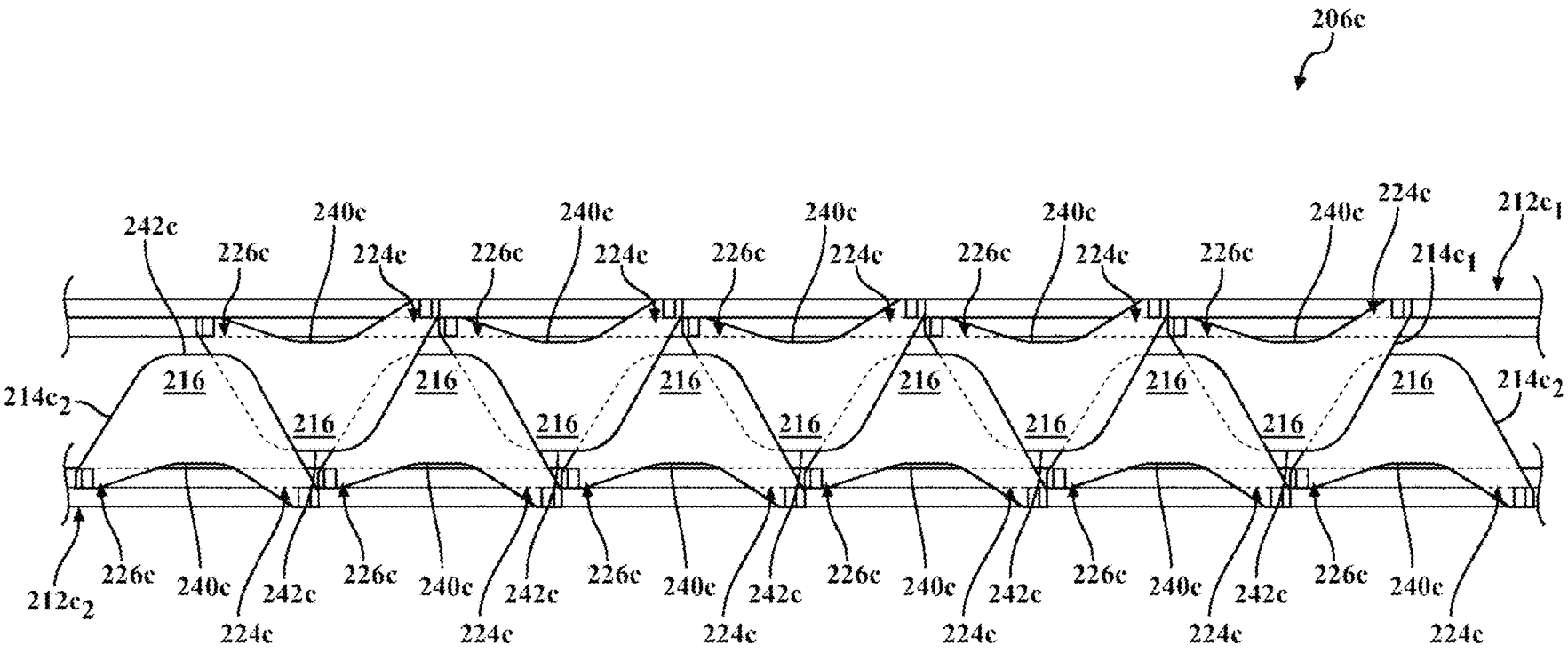
FIG. 5A is a plan view of an example of a locking structure according to the present disclosure, where the locking structure is in an unlocked state.
Figure 5B:
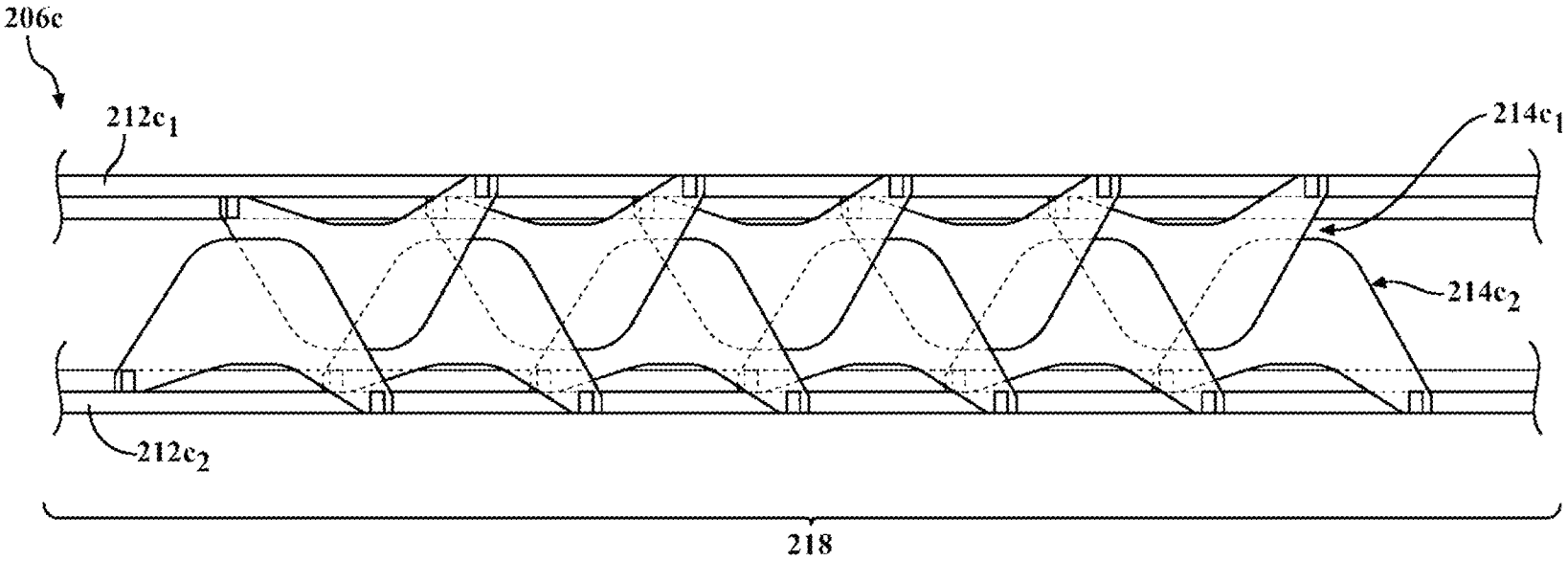
FIG. 5B is an example of the locking structure of FIG. 5A, where the locking structure is in a constricted state.
Figure 5C:
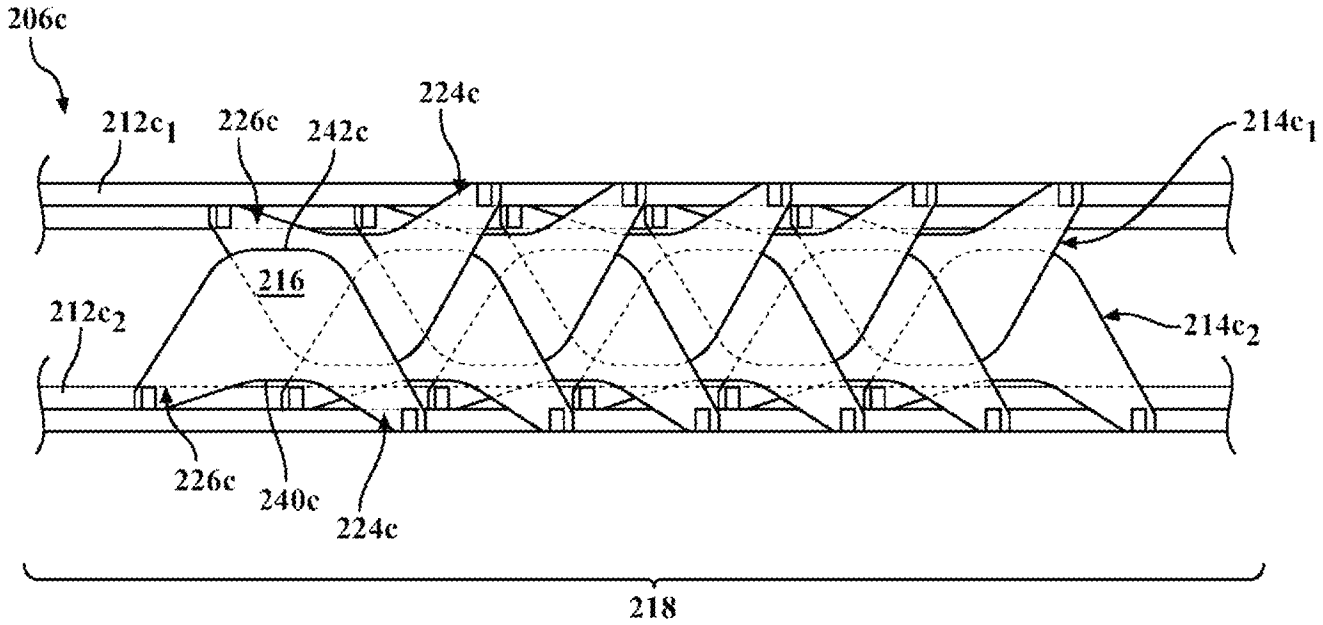
FIG. 5C is an example of the locking structure of FIG. 5B, where the locking structure is in a locked state.

With particular reference to FIGS. 5A-5C, a locking system 206*c* is provided and may be incorporated into a bladder 202 and a locking structure 200 disposed within the bladder 202 (FIG. 2). In view of the substantial similarity in structure and function of the components associated with the locking system 206*a*, like reference numerals are used hereinafter and in the drawings to identify like components while like reference numerals containing letter extensions are used to identify those components that have been modified.

With reference to FIGS. 5A-5C, the locking system 206*c* includes a first plurality of locking elements 214$c_1$ operably coupled to a first elastic element 212$c_1$ and a second plurality of locking elements 214$c_2$; operably coupled to a second elastic element 212$c_2$. In FIGS. 5A-5C, the first plurality of locking elements 214$c_1$ coupled to the first elastic element 212$c_1$ oppose the second plurality of locking elements 214$c_2$ coupled the second elastic element 212$c_2$. Stated differently, a free end 242*c* of each of the locking elements 214$c_1$, 214$c_2$ is disposed between the first and second elastic elements 212$c_1$, 212$c_2$. The locking elements 214$c_1$, 214$c_2$ are coupled to the respective elastic elements 212$c_1$, 212$c_2$ at the attachment regions 224*c*, 226*c* defined along an outer edge 240*c* of each locking element 214$c_1$, 214$c_2$. The configuration illustrated in FIGS. 5A-5C may maximize the interlocking under an at least partial vacuum to define a generally rigid locking system 206*c* as each of the free ends 242*c* of the locking elements 214$c_1$, 214$c_2$ is positioned proximate to the outer edge 240*c* of an adjacent locking element 214$c_1$, 214$c_2$.

The locking system 206*c* operates in a similar manner as described with respect to the locking systems 206*a*, 206*b* (FIGS. 3A-4), such that an interface surface 216 of each of the locking elements 214$c_1$, 214$c_2$ may overlap to be in direct contact with an interface surface 216 of an adjacent locking element 214$c_1$, 214$c_2$ when the second pressure is defined within the interior void 204 (FIG. 2). In this configuration, the first elastic member 212$c_1$ may be coupled to the first barrier layer 208*a* (FIG. 2), and the second elastic member 212$c_2$ may be coupled to the second barrier layer 208*b*. As each of the elastic elements 212$c_1$, 212$c_2$ may be respectively coupled to the first and second barrier layers 208*a*, 208*b* of the bladder 202 (FIG. 2), the bladder 202 is thus generally restricted from stretching or deforming around the wearer when the locking system 206*c* is in the locked state.

Further, the interlocking arrangement of the locking elements 214$c_1$, 214$c_2$ assists in providing added rigidity to the locking system 206*c*. For example, the free ends 242*c* of the first locking elements 214$c_1$ are interwoven between the free ends 242*c* of adjacent ones of the second locking elements 214$c_2$ and vice versa, such that the free ends 242*c* of the first locking elements 214$c_1$ are separated from one another by the free ends 242*c* of the second locking elements 214$c_2$. As the at least partial vacuum is defined within the interior void 204 (FIG. 2), the elastic elements 212$c_1$, 212$c_2$ contract to minimize the spacing between adjacent ones of the locking elements 214$c_1$, 214$c_2$ along a longitudinal direction. Stated differently, a greater surface area of the interface surfaces 216 of the locking elements 214$c_1$, 214$c_1$ overlap when the elastic elements 212$c_1$, 212$c_2$ are contracted under the at least partial vacuum. Referring to FIGS. 1 and 5A, when the at least partial vacuum is released from the bladder 202 via the valve 132, the elastic elements 212$c_1$, 212$c_2$ elongate as the bladder 202 returns to the relaxed, unlocked state.

Referring again to FIGS. 1-5C, the locking structure 200 advantageously provides structural support and a compressive fit for the wearer, such that the article may be custom-fit. The operability between the relaxed, unlocked state and the locked state assists the wearer in flexibly donning and doffing the article while simultaneously providing desired support and structure of the article for the wearer during use. The locking structure 200 may include any of the described configurations of the locking systems 206*a*-206*e*, as described here, such that each may be interchangeable and/or combined to provide the wearer with a customizable support structure to maximize the versatility of the article. Further, the locking structure 200 may be compressed or otherwise translated into the locked state utilizing vacuum pressure to define a frictional and/or tensile force to retain a position of the locking elements 214 in the locked state. The use of vacuum pressure maximizes the flexibility of transition between the locked and unlocked states by incorporating a pump to automatically and/or efficiently define the at least partial vacuum within the interior void 204 to compress or otherwise frictionally engage the locking elements 214 within the locking system 206.

The following Clauses provide an exemplary configuration for a locking structure for an article of athletic equipment, described above.

Clause 1. A locking structure for an article, the locking structure comprising a bladder including a first barrier element attached to a second barrier element to define a chamber having an interior void, at least one elastic element disposed within the interior void, and a plurality of locking elements disposed within the interior void and each attached to the at least one elastic element, each of the locking elements including an interface surface operable to selectively engage an interface surface of another one of the locking elements.

Clause 2. The locking structure of Clause 1, wherein the at least one elastic element includes a first fastening portion coupled to a first attachment region of each of the plurality of locking elements and a second fastening portion coupled to a second attachment region of each of the plurality of locking elements.

Clause 3. The locking structure of Clause 2, wherein the first and second attachment regions of each of the plurality of locking elements are defined along an outer edge of each of the plurality of locking elements and are asymmetrically coupled to the first and second fastening portions.

Clause 4. The locking structure of Clause 2, wherein the first attachment region is offset from the second attachment region relative to a longitudinal axis of the at least one elastic element.

Clause 5. The locking structure of Clause 2, wherein each of the plurality of locking elements defines an opening at a central region of each locking element and the first and second attachment regions are disposed proximate to the opening at the central region of each locking element.

Clause 6. The locking structure of Clause 2, wherein the at least one elastic element includes an outer fastening portion coupled to the first attachment region of the plurality of locking elements and an inner fastening portion coupled to the second attachment region of the plurality of locking elements.

Clause 7. The locking structure of any of the preceding Clauses, wherein the at least one elastic element comprises a locking strip that defines a locking system with the plurality of locking elements, and the locking system including a tether attached to one of the first barrier element and the second barrier element.

Clause 8. The locking structure of any of the preceding Clauses, wherein each of the locking elements includes a pair of interface surfaces disposed on opposite sides of each locking element.

Clause 9. The locking structure of Clause 8, wherein the interface surfaces of the locking elements are in direct contact with the interface surfaces of adjacent locking elements to form a locking layer.

Clause 10. An article of athletic equipment including the locking structure of any of the preceding Clauses.

Clause 11. A locking structure for an article, the locking structure comprising a bladder including a first barrier element attached to a second barrier element to define a chamber having an interior void, and a locking system including locking elements each attached to at least one elastic element and including at least one interface surface, the interior void of the bladder operable between a first pressure to move the locking system to a locked state and a second pressure to move the locking system to an unlocked state.

Clause 12. The locking structure of Clause 11, wherein the at least one elastic element includes a first fastening portion coupled to a first attachment region of each of the locking elements and a second fastening portion coupled to a second attachment region of each of the locking elements.

Clause 13. The locking structure of Clause 12, wherein the first and second attachment regions of each of the locking elements are defined along an outer edge of each of the locking elements and are asymmetrically coupled to the first and second fastening portions.

Clause 14. The locking structure of Clause 12, wherein the first attachment region is offset from the second attachment region relative to a longitudinal axis of the at least one elastic element.

Clause 15. The locking structure of Clause 12, wherein each of the locking elements defines an opening at a central region of each locking element and the first and second attachment regions are disposed proximate to the opening at the central region of each locking element.

Clause 16. The locking structure of Clause 12, wherein the at least one elastic element includes an outer fastening portion coupled to the first attachment region of the locking elements and an inner fastening portion coupled to the second attachment region of the locking elements.

Clause 17. The locking structure of any of the preceding Clauses, wherein the at least one elastic element comprises a locking strip that defines a locking system with the locking elements, and the locking system including a tether attached to one of the first barrier element and the second barrier element.

Clause 18. The locking structure of any of the preceding Clauses, wherein each of the locking elements includes a pair of interface surfaces disposed on opposite sides of each locking element.

Clause 19. The locking structure of Clause 18, wherein the interface surfaces of the locking elements are in direct contact with the interface surfaces of adjacent locking elements to form a locking layer.

Clause 20. A shin guard for an article of athletic equipment, the shin guard including the locking structure of any of the preceding Clauses.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. An article of equipment comprising:

a main body including a first surface operable to oppose a wearer during use and a second surface disposed on an opposite side of the main body than the first surface;

a first strap including a first end attached to the main body and a second end disposed on an opposite end of the first strap than the first end and attached to the main body at a different location than the first end, the first strap cooperating with the first surface of the main body to define a receptacle operable to receive a body portion of the wearer therein;

a bladder including a first barrier element attached to a second barrier element to define a chamber having an interior void, the bladder disposed within the first strap and extending along a longitudinal axis between the first end and the second end;

at least one elastic element disposed within the interior void; and a plurality of locking elements disposed within the interior void and each attached to the at least one elastic element, the locking elements including an interface surface operable to selectively engage an interface surface of another one of the locking elements in response to fluid being removed from the interior void to restrict elongation of the bladder, each of the plurality of locking elements defining an opening at a central region of each locking element, the at least one elastic element extending through the opening at the central region of each locking element to define a threaded arrangement with the plurality of locking elements.

2. The article of equipment of claim 1, wherein the at least one elastic element includes a first fastening portion coupled to a first attachment region of each of the plurality of locking elements and a second fastening portion coupled to a second attachment region of each of the plurality of locking elements.

3. The article of equipment of claim 2, wherein the first and second attachment regions of each of the plurality of locking elements are defined along an outer edge of each of the plurality of locking elements and are asymmetrically coupled to the first and second fastening portions.

4. The article of equipment of claim 2, wherein the first attachment region is offset from the second attachment region relative to a longitudinal axis of the at least one elastic element.

5. The article of equipment of claim 2, wherein the first and second attachment regions are disposed proximate to the opening at the central region of each locking element.

6. The article of equipment of claim 2, wherein the at least one elastic element includes an outer fastening portion coupled to the first attachment region of the plurality of locking elements and an inner fastening portion coupled to the second attachment region of the plurality of locking elements.

7. The article of equipment of claim 1, wherein the at least one elastic element comprises a locking strip that defines a locking system with the plurality of locking elements, the locking system extending from the first end of the first strap to the second end of the first strap.

8. The article of equipment of claim 1, wherein each of the locking elements includes a pair of interface surfaces disposed on opposite sides of each locking element.

9. The article of equipment of claim 8, wherein the interface surfaces of the locking elements are in direct contact with the interface surfaces of adjacent locking elements to form a locking layer.

10. The article of equipment of claim 1, further comprising a pump operable to selectively remove fluid from the interior void.

11. An article of equipment comprising:

a main body including a first surface operable to oppose a wearer during use and a second surface disposed on an opposite side of the main body than the first surface;

a first strap including a first end attached to the main body and a second end disposed on an opposite end of the first strap than the first end and attached to the main body at a different location than the first end, the first strap cooperating with the first surface of the main body to define a receptacle operable to receive a body portion of the wearer therein;

a bladder including a first barrier element attached to a second barrier element to define a chamber having an interior void, the bladder disposed within the main body;

at least one elastic element disposed within the interior void; and a plurality of locking elements disposed within the interior void and each attached to the at least one elastic element, the locking elements including an interface surface operable to selectively engage an interface surface of another one of the locking elements in response to fluid being removed from the interior void to restrict elongation of the bladder, each of the plurality of locking elements defining an opening at a central region of each locking element, the at least one elastic element extending through the opening at the central region of each locking element to define a threaded arrangement with the plurality of locking elements.

12. The article of equipment of claim 11, wherein the at least one elastic element includes a first fastening portion coupled to a first attachment region of each of the plurality of locking elements and a second fastening portion coupled to a second attachment region of each of the plurality of locking elements.

13. The article of equipment of claim 12, wherein the first and second attachment regions of each of the plurality of locking elements are defined along an outer edge of each of the plurality of locking elements and are asymmetrically coupled to the first and second fastening portions.

14. The article of equipment of claim 12, wherein the first attachment region is offset from the second attachment region relative to a longitudinal axis of the at least one elastic element.

15. The article of equipment of claim 12, wherein the first and second attachment regions are disposed proximate to the opening at the central region of each locking element.

16. The article of equipment of claim 12, wherein the at least one elastic element includes an outer fastening portion coupled to the first attachment region of the plurality of locking elements and an inner fastening portion coupled to the second attachment region of the plurality of locking elements.

17. The article of equipment of claim 11, wherein the at least one elastic element comprises a locking strip that defines a locking system with the plurality of locking elements, the locking system extending across a majority of the main body.

18. The article of equipment of claim 11, wherein each of the locking elements includes a pair of interface surfaces disposed on opposite sides of each locking element.

19. The article of equipment of claim 18, wherein the interface surfaces of the locking elements are in direct contact with the interface surfaces of adjacent locking elements to form a locking layer.

20. The article of equipment of claim 11, further comprising a pump operable to selectively remove fluid from the interior void.

* * * * *